United States Patent [19]

Becker et al.

[11] Patent Number: 4,569,653

[45] Date of Patent: Feb. 11, 1986

[54] LIGHTER OF THE DISPOSABLE TYPE HAVING A BOTTLE-OPENER FOR BOTTLES WITH CROWN-CORKS, WHICH IS ATTACHED TO SAID LIGHTER

[76] Inventors: Franz J. Becker, Schulstr. 13, 5451 Horhausen, Fed. Rep. of Germany; Alfred Racek, Seitenberggasse 54, A-1160 Vienna, Austria

[21] Appl. No.: 626,851

[22] PCT Filed: Oct. 31, 1983

[86] PCT No.: PCT/AT83/00032

§ 371 Date: Jun. 22, 1984

§ 102(e) Date: Jun. 22, 1984

[87] PCT Pub. No.: WO84/01812

PCT Pub. Date: May 10, 1984

[30] Foreign Application Priority Data

Nov. 2, 1982 [DE] Fed. Rep. of Germany ..... 3240377
Nov. 2, 1982 [DE] Fed. Rep. of Germany ..... 3240380
Dec. 6, 1982 [DE] Fed. Rep. of Germany ..... 3245016
Jan. 28, 1983 [DE] Fed. Rep. of Germany ..... 3302834
Aug. 8, 1983 [AT] Austria ..... 2864/83

[51] Int. Cl.[4] ..... B67B 7/00

[52] U.S. Cl. ..... 431/253; 81/3.55; 81/3.09; 7/151; D27/38; D8/34

[58] Field of Search ..... 431/253; 81/3.34, 3.1 R; 7/151; D27/38; D8/34

[56] References Cited

U.S. PATENT DOCUMENTS 2,828,855 4/1958 Mosch ..... 431/253
3,103,047 9/1963 Wolf ..... 81/3.1 R
4,373,223 2/1983 Miller ..... 431/253

*Primary Examiner*—Carroll B. Dority, Jr.
*Attorney, Agent, or Firm*—Karl F. Ross; Herbert Dubno

[57] ABSTRACT

Lighter of the disposable type having a bottle opener, for bottles with crown-corks (bottle caps), which is attached to the said lighter.

7 Claims, 12 Drawing Figures

FIG. 5
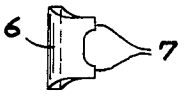
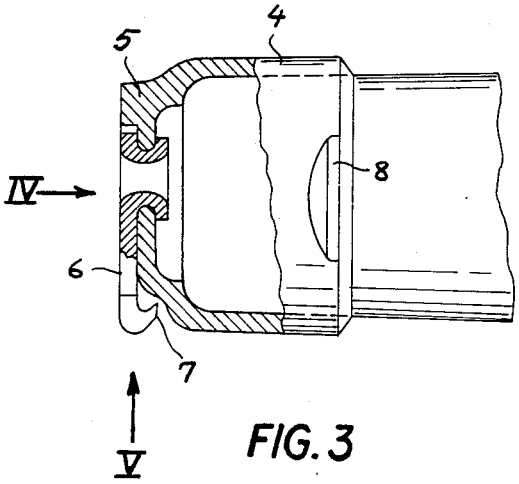
FIG. 3
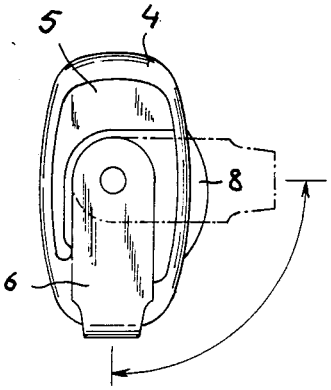
FIG. 4

FIG. 6
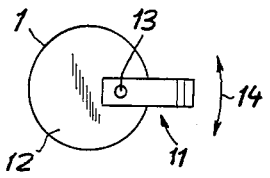
FIG. 7
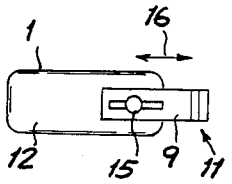
FIG. 8
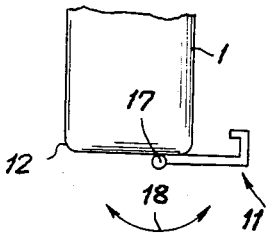
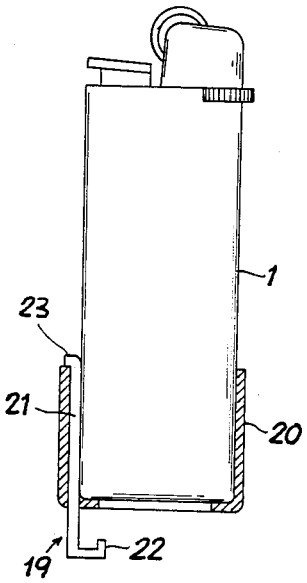
FIG. 9
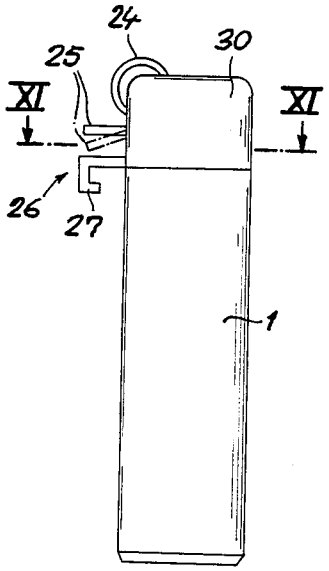
FIG. 10
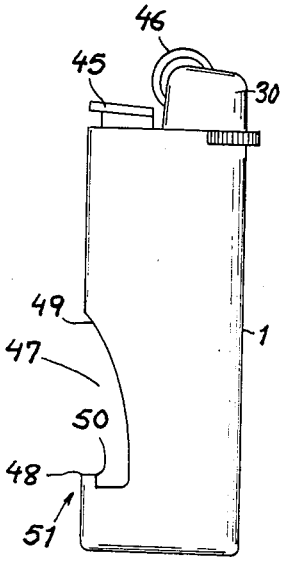
FIG. 12
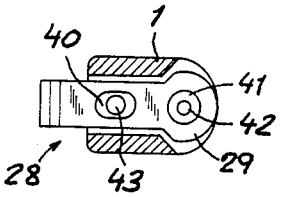
FIG. 11

LIGHTER OF THE DISPOSABLE TYPE HAVING A BOTTLE-OPENER FOR BOTTLES WITH CROWN-CORKS, WHICH IS ATTACHED TO SAID LIGHTER

CROSS REFERENCE TO RELATED APPLICATIONS

This application is an International phase application corresponding to the International application No. PCT/AT83/00032 filed Oct. 31, 1983 and based, in turn, on German International applications of Nov. 2, 1982, Dec. 6, 1982 and Jan. 28, 1983 and upon an Austrian application of Aug. 8, 1983.

FIELD OF THE INVENTION

The invention relates to a lighter, more particularly a disposable lighter.

BACKGROUND OF THE INVENTION

Lighters are known in the widest variety of designs. So-called disposable lighters usually consist of an elliptical, rectangular or circular housing at the top of which is located the burner head with an actuating part consisting of a fuel-release lever and an igniting friction wheel. These mass-produced, and therefore inexpensive, disposable lighters have attained considerable success on the market, and almost everybody carries such a lighter.

Also known is a very wide variety of openers for bottles with crown-corks or bottle caps. Thus the user of a lighter who also wishes to keep a bottle-opener handy must always carry two separate articles with him; these take up a relatively large amount of space and it is always possible to mislay one article or the other.

OBJECT OF THE INVENTION

It is the purpose of the invention to provide a lighter which may also be used to open bottles having crown-corks.

According to the invention, this purpose is achieved by means of an opener for bottles with crown-corks which is connected to a lighter. In this way, a single article provides a flame and opens the crown-cork of a bottle. The combination of a lighter and a bottle-opener produces a very handy unit which takes up little space. Furthermore, the danger of mislaying the combined unit is lessened since, when the user thinks of taking the lighter with him, the bottle-opener goes along too, and vice-versa. In this way, the lighter and bottle-opener are always at hand.

According to one configuration of the invention, the lighter housing has an indentation bounded on one side by a bent tongue and, on the other side, by a lever surface in the form of an extension of the relevant edge of the indentation. This arrangement of the bottle-opener directly in the lighter housing produces an extremely compact unit with no projections, thus causing less wear in the pockets of clothing.

The design described hereinbefore, however, requires substantial changes in the housings of known lighters. According to another feature of the invention, therefore, a lighter is provided which can be produced quite simply and almost without any change in the existing shape of the housing. In one embodiment, this is made possible by arranging the bottle-opener in the vicinity of the fuel-release lever of the lighter. In this case, the said bottle-opener is secured to the lighter-housing immediately below the open-position of the said fuel-release lever.

Nor is any change required in the conventional lighter-housing if, according to another characteristic of the invention, the bottle-opener is arranged upon a sleeve adapted to be slipped onto the lighter. In this case, the bottle-opener is preferably held, in the non-operative position, in or on the lighter-sleeve, whence it can be folded or slid into the operative position. According to one possible design, the bottle-opener is in the form of a S-shaped lever adapted to slide longitudinally between the slip-on sleeve and the lighter-housing, one end of the said lever carrying a bent tongue for opening the crown-cork, while the other end carries a bent stop which limits the path of travel of the said lever.

In order to keep the stresses on the lighter housing during the opening of a bottle as low as possible, provision is made, according to a preferred example of embodiment of the invention, to arrange on the lighter, at a distance from the hook for engaging the crown-cork, a projection designed to bear upon the said cork. The combination, according to the invention, of a hook and a corresponding projection, makes it possible to use the lighter housing as a double-ended lever, the length of the load- and force-arm being clearly defined by the location of the projection. Moreover, the forces necessary to open the cork cannot become unacceptably high as a result of inadvertent displacement of the bearing point. The said projection is preferably designed, at least in part, as a part of a cylinder, more particularly a circular cylinder, thus ensuring reliable bearing against the cork.

The hook is preferably equipped with stepped tooth-like projections which grip the crown-cork reliably.

BRIEF DESCRIPTION OF THE DRAWING

The invention is explained hereinafter in greater detail in conjunction with the examples of embodiment illustrated in the drawing attached hereto, wherein:

FIG. 3 is a partial sectional view of the sleeve with the hook pivoted inwardly;

FIG. 4 is an end view in the direction of arrow IV in FIG. 3;

FIG. 5 is a view of the hook in the direction of arrow V in FIG. 3; and

FIGS. 6 to 12 show additional examples of embodiment of the invention.

SUMMARY OF THE INVENTION

Figure 1:
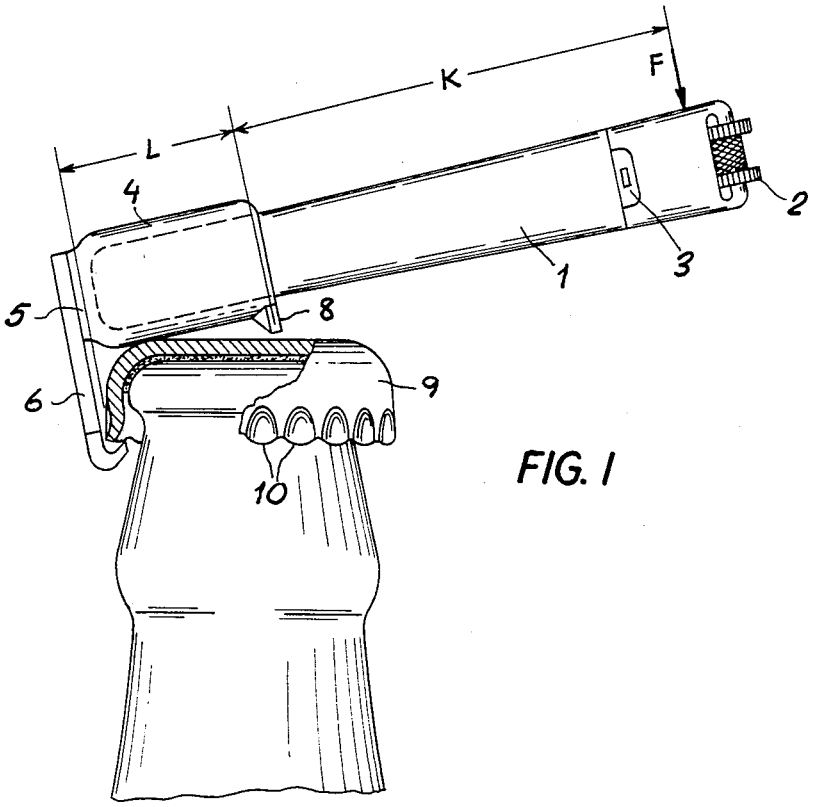
FIG. 1 is a view of a side elevational lighter according to the invention placed upon the neck of a bottle having a bottle cap shown partially in section at the start of the opening process.
Figure 2:
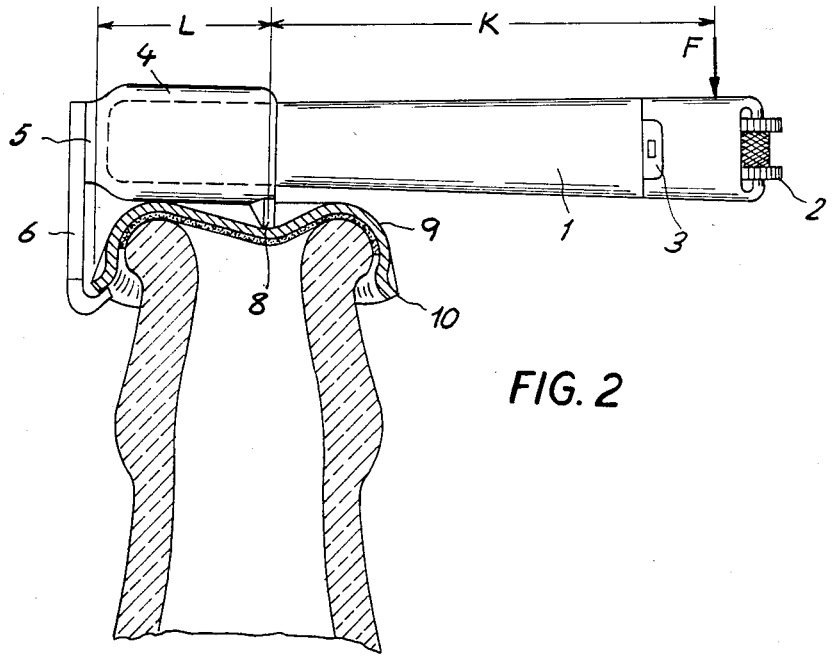
FIG. 2 is a similar view at the end of the opening process.

According to FIGS. 1 and 2, a lighter comprises an elongated housing 1 at the top of which are arranged, in known fashion, a friction wheel 2 and an actuating lever 3 for the gas valve in a lighter head.

A sleeve 4 is slipped over the end of housing 1 remote from friction-wheel 2 and is preferably welded to the said housing. Mounted pivotably on the bottom 5 of the said sleeve is a hook 6, the pivot-axis being formed by riveting the material of the hook. As may be gathered from FIG. 5, hook 6 is equipped with stepped tooth-like projections 7.

Arranged on the side of sleeve remote from hook 6 is a projection 8 designed as a part of a cylindrical surface.

If the lighter is to be used to open a crown-cork, hook 6 is pivoted out of the position shown in FIG. 4 in full lines, through 90°, into the position shown in dotted lines. The lighter is then placed, as shown in FIG. 1, upon the crown-cork, in such a manner that hook 6 engages under the edge of crown-cork 9. At this time, stepped tooth-like projections 7 can engage effectively with two teeth 10 on the said crown-cork. Projection 8 now bears upon the central part of the crown-cork in such a manner that, when a force F is applied to lighter housing 1, the latter acts as a double-ended lever having a load-arm L and a force-arm K. The lengths of the two arms of the lever remain substantially equal until the crown cork has been opened and the position according to FIG. 2 has been reached.

It has been found that the force F necessary to open a crown-cork is of the order of approximately 55N.

In the absence of projection 8, it would be possible for lighter housing 1 to bear relatively quickly upon the end of the crown-cork facing hook 6, thus lengthening the load-arm and shortening the force-arm.

FIGS. 6 to 8 illustrate alternative ways of securing a bottle-opener 11 to bottom 12 of lighter-housing 1. In FIG. 6, lighter housing 1 is of circular cross-section and bottle-opener 11 is fitted eccentrically to bottom 12 of housing 1 in such a manner as to pivot in the direction of arrow 14. In the embodiment of FIG. 7, lighter housing 1 is of rectangular cross-section and bottle-opener 11 is secured to bottom 12 of housing 1, by means of an elongated hole 15, allowing it to move in the direction of double-arrow 16. In the embodiment of FIG. 8, housing 1 is again of rectangular cross-section and bottle-opener 11 is secured to bottom 12 of housing 1, by means of hinge 17 running parallel with the relevant narrow side of the said housing, in such a manner as to fold in the direction of double arrow 18. Hinge 17 is made stiff in order to lock the bottle-opener in both the operative and the inoperative position.

In the example of embodiment according to FIG. 9, bottle opener 19 is in the form of an S-shaped lever 21 adapted to move longitudinally between a slip-on sleeve 20 and lighter housing 1. One end of lever 21 in in the form of a bent tongue 22 for opening the crown-cork, while the other end thereof is in the form of a bent stop 23 which limits the path of travel of the said lever. In this case, therefore, bottle opener 19 is adapted to be moved into an operative and an inoperative position.

In the embodiment according to FIGS. 10 and 11 (FIG. 11 being a cross-section along the line XI—XI in FIG. 10), housing 1 has a burner head 30 arranged at the upper end and comprising a friction-wheel 24 and a fuel-release lever 25. Located below this lever is the functional part of bottle-opener 26. The one-piece bottle-opener consists of a functional part projecting from housing 1 in the form of a hook 27 with two bends, and a retaining part 28 secured between housing 1 and burner-head 30. Retaining part 8 is in the form of a plate 29 with openings 40, 41 for the passage of burner nozzle 42 and flint-holder 43.

In the variant according to FIG. 12, the lighter housing is of elliptical cross-section with a burner-head 30 at the top comprising a fuel-release lever 45 and a friction wheel 46. Located at the lower end of housing 1 is in an indentation 47 bounded on one side by a bent tongue 48 and, on the other side by a lever-surface 49 in the form of an extension of the relevant edge of the said indentation. The side of tongue 48 facing lever surface 49 has a surface 50 which engages under several crimps in the crown-cork. When bottle opener 51, thus integrated with the lighter, is in use, lever surface 49 comes to rest upon the upper surface of the crown-cork on a bottle and, at the same time, surface 50 of tongue 48 engages under several crimps in the crown-cork. When lighter housing 1 is pressed down, the crown-cork is lifted from the bottle.

The embodiments of the invention in which an exclusive property or privilege is claimed are define as follows:

I claim:

1. A disposable lighter, comprising:

an elongated lighter housing having an axis;

a lighter head formed on one end of said housing and including a valve controller for releasing a fuel and a striker for igniting the released fuel;

a member movably mounted on said housing and provided with a free end having a hook-shaped formation engageable with an edge of a bottle cap for enabling the prying of said bottle cap from the mouth of a bottle; and support means connecting said member to said housing to enable said formation to be shifted into a position wherein it is spaced from a portion of said housing which can be brought to bear against said cap to apply lever action thereto in the prying of said cap from said mouth, and a position in which said formation is relatively proximal to a surface of said housing so that catching in a pocket is avoided, said support means including a sleeve having a flat end, said member having a plate pivotally mounted on said end of said sleeve for swinging movement about an axis parallel to said axis of said housing between said positions.

2. The lighter defined in claim 1 wherein said sleeve is of oval configuration.

3. A disposable lighter, comprising:

a lighter housing;

a lighter head formed on one end of said housing and including a valve controller for releasing a fuel and a striker for igniting the released fuel;

a member movably mounted on said housing and provided with a free end having a hook-shaped formation engageable with an edge of a bottle cap for enabling the prying of said bottle cap from the mouth of a bottle; and support means connecting said member to said housing to enable said formation to be shifted into a position wherein it is spaced from a portion of said housing which can be brought to bear against said cap to apply lever action thereto in the prying of said cap from said mouth, and a position in which said formation is relatively proximal to a surface of said housing so that catching in a pocket is avoided, said formation having a pair of stepped toothlike projections.

4. The lighter defined in claim 3 wherein said support means includes a sleeve carrying said member and fitted onto said housing.

5. The lighter defined in claim 4 wherein said member is pivotally connected to said sleeve at an end thereof.

6. The lighter defined in claim 5 wherein said member is pivotally connected to said sleeve for swinging movement between said positions about an axis offset from an axis of said housing.

7. The lighter defined in claim 4 wherein said member is linearly shifted on said sleeve and has an S configuration defined in part by a bent stop at an end of said lever opposite said formation limiting the displacement of said lever.

* * * * *